US008847119B2

(12) United States Patent
Hildner et al.

(10) Patent No.: US 8,847,119 B2
(45) Date of Patent: Sep. 30, 2014

(54) COOKING OVEN WITH A CATALYTIC FILTER SYSTEM

(75) Inventors: Dietmar Hildner, Furth (DE); Gerhard Schaff, Cadolzburg (DE); Branko Ivanovic, Wurzburg (DE)

(73) Assignee: Electrolux Home Products Corporation N.V., Brussel (BE)

( * ) Notice: Subject to any disclaimer, the term of this patent is extended or adjusted under 35 U.S.C. 154(b) by 338 days.

(21) Appl. No.: 13/318,948

(22) PCT Filed: Jun. 16, 2010

(86) PCT No.: PCT/EP2010/003628

§ 371 (c)(1),
(2), (4) Date: Nov. 4, 2011

(87) PCT Pub. No.: WO2011/003504

PCT Pub. Date: Jan. 13, 2011

(65) Prior Publication Data

US 2012/0090592 A1 Apr. 19, 2012

(30) Foreign Application Priority Data

Jul. 8, 2009 (EP) ..... 09008905

(51) Int. Cl.
*F24C 15/20* (2006.01)

(52) U.S. Cl.
CPC ..... *F24C 15/2014* (2013.01)
USPC ..... 219/400; 219/391; 126/19 R; 126/21 R

(58) Field of Classification Search
None
See application file for complete search history.

(56) References Cited

U.S. PATENT DOCUMENTS 3,785,778 A * 1/1974 Burstein et al. ..... 422/171
4,113,439 A * 9/1978 Ookubo et al. ..... 422/177
4,493,976 A * 1/1985 Wilson ..... 219/398

(Continued)

FOREIGN PATENT DOCUMENTS

DE 4142336 6/1993
EP 0831277 3/1998

(Continued)

OTHER PUBLICATIONS

International Search Report for PCT/EP2010/003628, dated Jan. 24, 2011, 3 pages.

*Primary Examiner* — Joseph M Pelham
(74) *Attorney, Agent, or Firm* — Pearne & Gordon LLP

(57) ABSTRACT

The present invention relates to a cooking oven with at least one oven cavity, at least one air outlet conduit and at least one catalytic filter system, in particular a fat, grease and/or odor filter system. The catalytic filter system comprises a housing (10, 14) containing a catalyser element (12). The catalytic filter system is arranged within the air outlet conduit and outside of the oven cavity. The housing (10) includes a plurality of the inlet holes (20) in a wall (16) facing the oven cavity. The housing (10) includes a plurality of the outlet holes (34) in a wall (30) opposite to the oven cavity. The catalytic filter system is fixed outside of the oven cavity by fixing elements. At least one heating element (40; 50) is arranged upstream of the catalytic filter system. The heating element (40; 50) is provided for heating the catalytic filter system. The heating element (40; 50) is arranged within the oven cavity and is additionally provided for heating the oven cavity and the fixing elements are outside of the oven cavity and outside of the air outlet conduit.

19 Claims, 3 Drawing Sheets

(56) References Cited

U.S. PATENT DOCUMENTS

Figure 1:
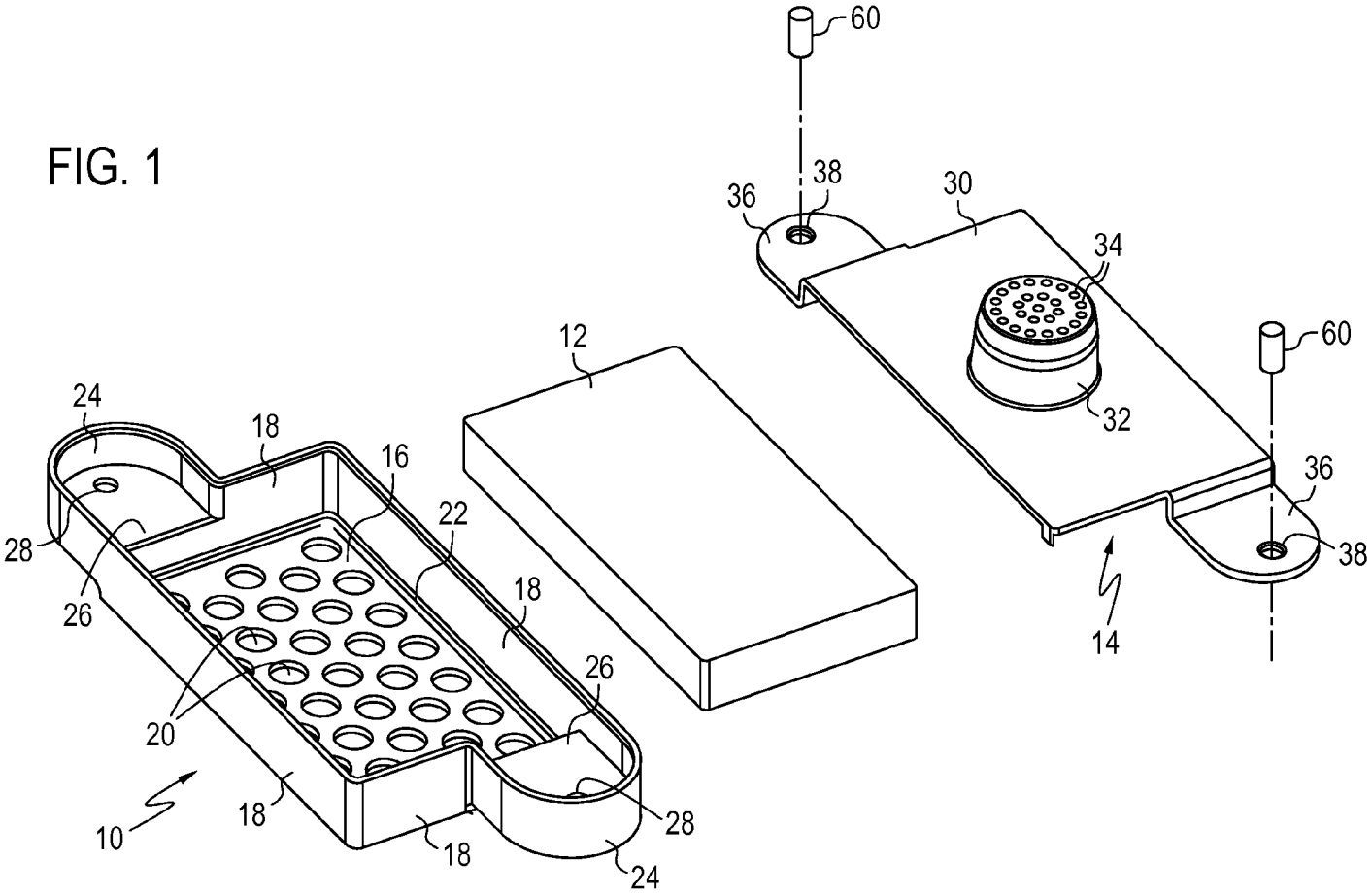

| | | | | |
|---|---|---|---|---|
| 4,944,283 | A * | 7/1990 | Tsuchiya et al. | 126/41 R |
| 5,094,222 | A * | 3/1992 | Fukuda et al. | 126/19 R |
| 5,780,815 | A * | 7/1998 | Mestnik et al. | 219/400 |
| 6,250,296 | B1 | 6/2001 | Norris et al. | |
| 7,370,647 | B2 * | 5/2008 | Thorneywork | 126/21 A |
| 8,006,685 | B2 * | 8/2011 | Bolton et al. | 126/21 A |
| 8,418,684 | B2 * | 4/2013 | Robinson, Jr. | 126/19 R |
| 2002/0059930 | A1 * | 5/2002 | Schmidmayer et al. | 126/19 R |
| 2003/0116555 | A1 | 6/2003 | Wakefield et al. | |
| 2004/0163635 | A1 * | 8/2004 | Thorneywork | 126/21 A |
| 2009/0050129 | A1 * | 2/2009 | Robinson, Jr. | 126/19 R |

FOREIGN PATENT DOCUMENTS

| | | | | |
|---|---|---|---|---|
| FR | 2689618 | A1 * | 10/1993 | F24C 15/00 |
| FR | 2724832 | | 3/1996 | |
| GB | 1206829 | | 9/1970 | |
| GB | 2398628 | | 8/2004 | |

* cited by examiner

COOKING OVEN WITH A CATALYTIC FILTER SYSTEM

The present invention relates to a cooking oven with a catalytic filter system according to the preamble of claim 1.

In an oven cavity water vapour, vaporised fats ands oils, condensate, odorous substances, formaldehyde and other substances are generated by different processes, e.g. cooking, baking or pyrolysis. In the prior art ceramic disks, metal filters and metal grids are used in order to filter the above substances. A catalytic coating is used in order to optimize the effect.

DE 41 42 336 A1 discloses a cooking oven with a catalytic filter system. The catalytic filter system is arranged within a clearance hole in the top wall of the oven cavity. The catalytic filter system comprises a ceramic catalyser and an electric heating element. The catalyser as well as the electric heating element is arranged within the clearance hole in the top wall of the oven cavity. The installation of the catalytic filter system and the catalytic filter system itself is relative complex.

It is the object of the present invention to provide an improved cooking oven with a catalytic filter system, wherein the catalytic filter system can be easily produced and installed in the cooking oven.

This object is achieved by the cooking oven according to claim 1.

According to the present invention the heating element is arranged within the oven cavity and is additionally provided for heating the oven cavity and all the fixing elements are outside of the oven cavity and outside of the air outlet conduit.

The core of the present invention is the arrangement of the heating element within the oven cavity on the one hand and the fixation of the catalytic filter system outside of the oven cavity and outside of the air outlet conduit on the other hand.

Said heating element may be a separate heating element exclusively for the catalytic filter system. Alternatively, the heating element may be a part or an appendix of the upper heating element for the oven cavity. The heating element can be easily installed within the oven cavity. In a similar way, the catalytic filter system can be easily installed on the exterior of the oven cavity.

According to the preferred embodiment of the present invention the housing includes a casing with a bottom wall and side walls and a cover for covering an open top side of said casing. This allows a fast installation of the housing and the catalyser element. The catalyser element can be exchanged by a simple way.

Further, the bottom wall of the casing includes a circumferential channel enclosing a portion with the inlet holes. Condensates can be collected in said circumferential channel. In particular, the circumferential channel is embossed in the bottom wall of the casing.

Preferably, the cover may comprise a connecting device for connecting a tube or a pipe forming a part of the air outlet conduit. Thus, the further part of the air outlet conduit can be easily connected.

The plurality of outlet holes may be arranged at the connecting device. The outlet holes are smaller than the inlet holes.

According to the preferred embodiment of the present invention the cross-section of the heating element may be adapted to the cross-section of the catalytic filter system. This structure allows an optimum heat transfer.

Further, the distance between the heating element and the catalytic filter system may be 1 mm to 10 mm. In particular, the distance between the heating element and the bottom wall of the casing may be 1 mm to 10 mm. This small distance contributes also to an efficient heat transfer.

According to the preferred embodiment of the present invention the catalytic filter system is arranged at the outer side of a cavity wall of the oven cavity. This allows a simple installation of the catalytic filter system in the cooking oven.

According to an additional feature of the present invention, the oven cavity comprises a reflective sheet element arranged below or besides the heating element. The reflective sheet element increases the effect of the heat transfer.

Preferably, the heating element is arranged between the reflective sheet element and the bottom wall and of the casing. This allows an efficient use of the heat.

Further, the reflective sheet element comprises a plurality of holes. This guarantees the transmissibility of the air outlet conduit. Alternatively, reflective sheet element may comprise a plurality of slots.

For example, the reflective sheet element has a plane or a chambered structure, so that the reflective sheet element covers or encloses, respectively, that portion of the heating element, which is averted from the catalytic filter system.

At last, the reflective sheet element is provided as a fat filter. Thus, the reflective sheet element may have two different purposes. This reflective sheet also contributes to a low complexity.

Figure 3B:
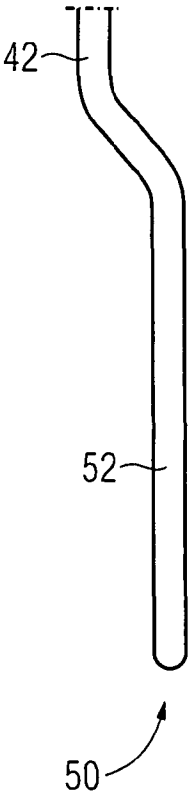
Figure 3A:
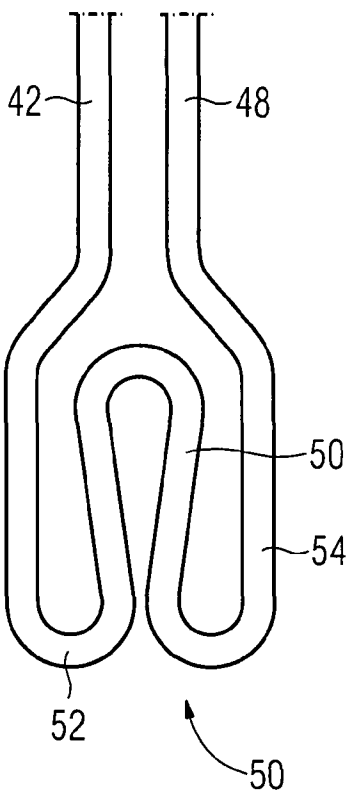

The invention will be explained in more detail below by means of exemplary embodiments. Reference is thereby made to the accompanied drawings, wherein FIG. 1 shows a schematic perspective view of a catalytic filter system according to a preferred embodiment of the present invention in a demounted state, FIG. 2A shows a schematic top view of an electric heating element for the catalytic filter system according to a first embodiment of the present invention, FIG. 2B shows a schematic side view of the electric heating element for the catalytic filter system according to the first embodiment of the present invention, FIG. 3A shows a schematic top view of an electric heating element for the catalytic filter system according to a second embodiment of the present invention, and FIG. 3B shows a schematic side view of the electric heating element for the catalytic filter system according to the second embodiment of the present invention.

Figure 4:
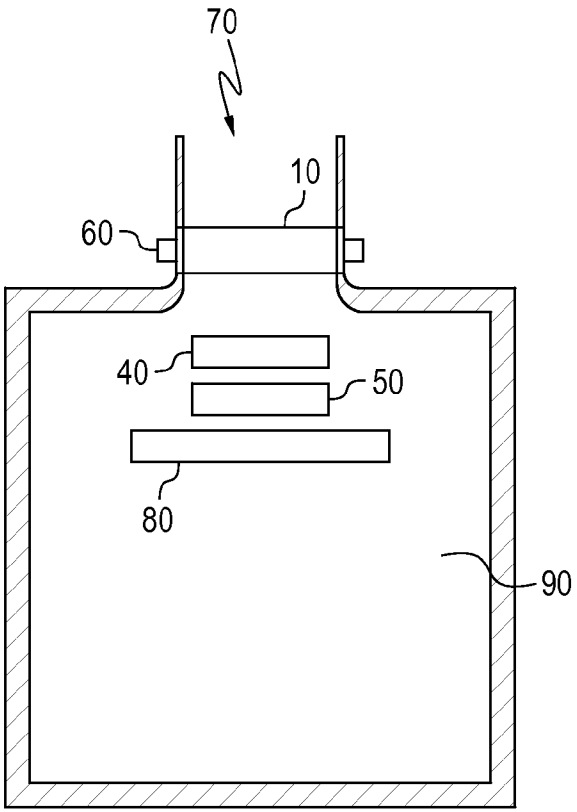

FIG. 4. shows a schematic view of cooking oven with a catalytic filter system according to one embodiment.

Figure 5:
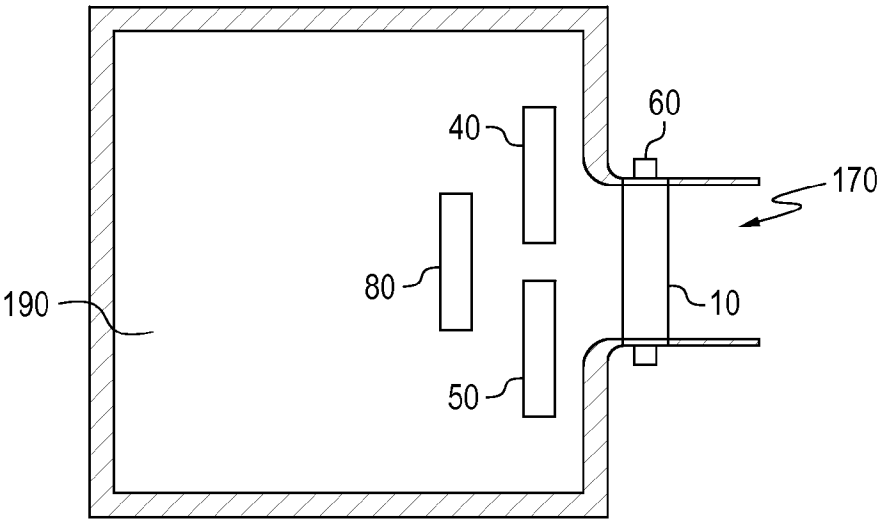

FIG. 5. shows a schematic view of a cooking oven with a catalytic filter system according to another embodiment.

Figure 2B:
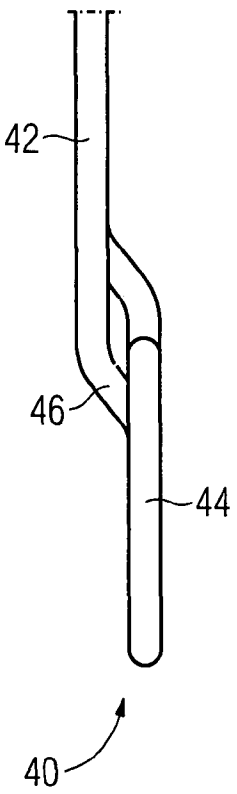
Figure 2A:
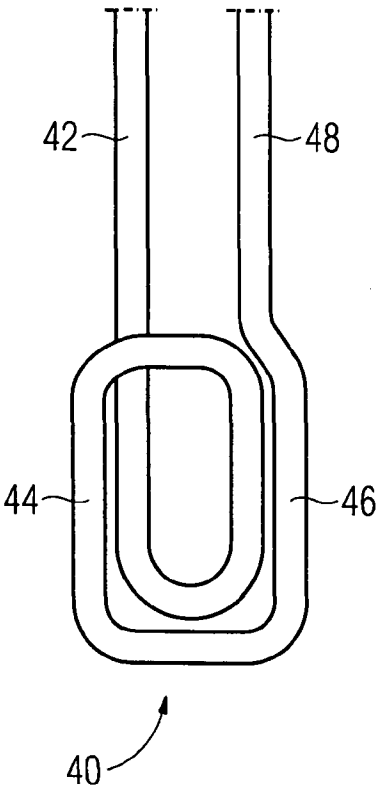

FIG. 1 shows a schematic perspective view of a catalytic filter system according to a preferred embodiment of the present invention in a demounted state. The catalytic filter system comprises a casing 10, a catalyser element 12 and a cover 14. The casing 10 and the cover 14 form a housing for containing the catalyser element 12.

The casing 10 includes a bottom wall 16 and four side walls 18. The casing 10 has an open top side. The bottom wall 16 comprises a plurality of inlet holes 20 in its inner portion. These inlet holes 20 are required for the transmissibility of an air outlet conduit of oven cavity. In its outer portion the bottom wall 16 comprises a circumferential channel 22 enclosing the inner portion of the bottom wall 16. Said circumferential channel 22 is provided for collecting condensates.

Two opposite side walls 18 of the casing 10 comprises a salient portion 24 in each case. In this example the salient portion 24 has a semicircular cross-section. A bottom part 26 of the salient portion 24 comprises a fixing hole 28. In this embodiment the casing 10 is formed as a single-piece part. The casing 10 is provided to contain the catalyser element 12.

The catalyser element 12 is block-shaped. In general, the design of the catalyser element 12 is adapted to the design of the casing 10 without the salient portions 24. The catalyser element 12 is made of foamed ceramic or honeycomb ceramic. The surface of the catalyser element 12 is coated by platinum, palladium and/or rhodium.

The cover 14 includes a top wall 30, a connecting device 32 and two appendices 36. The top wall 30 is formed as a rectangular sheet. The top wall 30 is adapted to the open top side of the casing 10. The connecting device 32 is formed as a cylindrical salient in the centre of the top wall 30. In its top surface the connecting device 32 comprises a plurality of outlet holes 34. Said outlet holes 34 are smaller than the inlet holes 20 of the casing 10. These outlet holes 34 are also required for the transmissibility of the air outlet conduit.

The appendices 36 are adapted to the bottom parts 26 of the casing 10. The appendices 36 comprise one fixing hole 38 in each case. The position of said fixing holes 38 is adapted to the corresponding fixing holes 28 of the casing 10. The connecting device 34 is provided for connecting a tube or a pipe. Said tube or pipe form a part of the air outlet conduit. In this example the cover 14 is formed as a single-piece part.

The casing 10 and the cover 14 are attachable at the outside of an oven cavity. A fixing element 60 penetrates the fixing hole 38 of the cover 14 and the corresponding fixing hole 28 of the casing 10 and enters outer side of a wall of the oven cavity. The bottom wall 16 of the casing 10 covers an aperture in the cavity wall. Said aperture is a part of the air outlet conduit. Thus, the catalyser element 12 is arranged within the air outlet conduit. The fixing element 60, the fixing hole 38 of the cover 14 and the fixing hole 28 of the casing 10 are arranged outside of the air outlet conduit.

In this example the catalytic filter system is provided for a top wall of the oven cavity. The circumferential channel 22 in the bottom wall 16 is provided for collecting liquids, in particular condensates.

For example, the casing 10 and the cover 14 are made of aluminium, silicon or zinc.

FIG. 2A shows a schematic top view of an electric heating element 40 for the catalytic filter system according to a first embodiment of the present invention. The heating element 40 includes a first supply line 42, an outer loop 44, an inner loop 46 and a second supply line 48. The size of the outer loop 44 is adapted to the size of the bottom wall 16 of the casing 10.

FIG. 2B shows a schematic side view of the electric heating element 40 for the catalytic filter system according to the first embodiment of the present invention. FIG. 2B clarifies the structure of the heating element 40 and the levels of the single portions of said heating element 40 shown in FIG. 2A.

FIG. 3A shows a schematic top view of an electric heating element 50 for the catalytic filter system according to a second embodiment of the present invention. The heating element 50 includes a first supply line 42, a first lateral loop 54, a central loop 52, a second lateral loop 56 and a second supply line 48. The heating element 50 has a serpentine form. The size of that portion formed by the first lateral loop 54, the central loop 52 and the second lateral loop 56 is adapted to the size of the bottom wall 16 of the casing 10.

FIG. 3B shows a schematic side view of the electric heating element 50 for the catalytic filter system according to the second embodiment of the present invention. FIG. 3B clarifies the structure of the heating element 50 and the levels of the single portions of said heating element 50 shown in FIG. 3A.

FIG. 4 shows the heating elements 40 and 50 are arranged within the oven cavity 90 and below the catalytic filter system 10, if said catalytic filter system 10 is arranged within the air outlet conduit 70 on the top wall of the oven cavity 90. Alternatively, FIG. 5 shows if the catalytic filter system 10 is arranged within the air outlet conduit 170 at a side wall of the oven cavity 190, then the heating elements 40 and 50 should be arranged within the oven cavity 190 and beside the catalytic filter system 10.

Preferably, the distance between the heating element 40 or 50 and the bottom wall 16 of the casing 10 is about 1 mm to 10 mm.

The heating elements 40 and 50 may be separate devices especially for heating the catalytic filter system. Further, the heating elements 40 or 50 may be a part or an appendix of an upper heating element, which is primarily provided for heating the oven cavity.

Below the heating element 40 or 50 a reflective sheet element 80 may be arranged in order to reflect the thermal radiation from the heating element 40 or 50 to the catalyser element 12. Said reflective sheet element 80 has a plane or a chambered structure.

The reflective sheet element covers or encloses, respectively, that portion of the heating element 40 or 50, which is averted from the catalytic filter system. Thus, the heating element 40 or 50 is arranged between the reflective sheet element and the catalytic filter system. The reflective sheet element may comprise a reflective coating.

Further, the reflective sheet element may have an additional function as a fat or grease filter. Such a reflective fat or grease filter contributes to a low complexity of the cooking oven.

LIST OF REFERENCE NUMERALS

10 casing
12 catalyser element
14 cover
16 bottom wall
18 side wall
20 inlet hole
22 circumferential channel
24 salient portion
26 bottom part
28 fixing hole of the casing
30 top wall
32 connecting device
34 outlet hole
36 appendix
38 fixing hole of the casing
40 heating element of the first embodiment
42 first supply line
44 outer loop
46 inner loop
48 second supply line
50 heating element of the second embodiment
52 central loop
54 first lateral loop
56 second lateral loop

The invention claimed is:

1. A cooking oven with at least one oven cavity, at least one air outlet conduit and at least one catalytic filter system, wherein the catalytic filter system comprises a housing (10, 14) containing a catalyser element (12), wherein the housing (10) includes a plurality of inlet holes (20) in a wall (16)

facing the oven cavity, further wherein the housing (10) includes a plurality of outlet holes (34) in a wall (30) opposite to the oven cavity, the catalytic filter system is arranged within the air outlet conduit and outside of the oven cavity, the catalytic filter system is fixed outside of the oven cavity at an outside cavity wall of the oven cavity by fixing elements, wherein all the fixing elements are outside the air outlet conduit, and at least one heating element (40; 50) is arranged upstream of the catalytic filter system, wherein, the heating element (40; 50) is provided for heating the catalytic filter system, further wherein the heating element (40; 50) is arranged within the oven cavity and is additionally provided for heating the oven cavity.

2. The cooking oven according to claim 1, characterized in that the housing includes a casing (10) with a bottom wall (16) and side walls (18) and a cover (14) for covering an open top side of said casing (10).

3. The cooking oven according to claim 2, characterized in that the bottom wall (16) of the casing (10) includes a circumferential channel (22) enclosing a portion with the inlet holes (20).

4. The cooking oven according to claim 3, characterized in that the circumferential channel (22) is embossed in the bottom wall (16) of the casing (10).

5. The cooking oven according to claim 1, characterized in that the cover (14) comprises a connecting device (32) for connecting a tube or a pipe forming a part of the air outlet conduit.

6. The cooking oven according to claim 5, characterized in that the plurality of outlet holes (43) are arranged at the connecting device (32).

7. The cooking oven according to claim 1, characterized in that: a cross-section of the heating element (40; 50) is adapted to match a cross-section of the bottom wall (16) of the casing (10) of the catalytic filter system.

8. The cooking oven according to claim 1, characterized in that the distance between the heating element (40; 50) and the is catalytic filter system is 1 mm to 10 mm.

9. The cooking oven according to claim 1, characterized in that the distance between the heating element (40; 50) and the bottom wall (16) of the casing is 1 mm to 10 mm.

10. The cooking oven according to claim 1, characterized in that the catalytic filter system is arranged at the outer side of a cavity wall of the oven cavity.

11. The cooking oven according to claim 1, characterized in that the oven cavity comprises a reflective sheet element arranged below or besides the heating element (40; 50).

12. The cooking oven according to claim 11, characterized in that the heating element (40; 50) is arranged between the reflective sheet element and the bottom wall (16) and of the casing (10).

13. The cooking oven according to claim 11, characterized in that: the reflective sheet element comprises a plurality of holes.

14. The cooking oven according to claim 11, characterized in that the reflective sheet element has a plane or a chambered structure, so that the reflective sheet element covers or encloses, respectively, that portion of the heating element (40; 50), which is averted from the catalytic filter system.

15. The cooking oven according to claim 11, characterized in that the reflective sheet element is provided as a fat filter.

16. A catalytic filter system for a cooking oven with at least one oven cavity and at least one air outlet conduit comprising:

a housing containing a catalyser element, the housing includes a plurality of inlet holes in a bottom wall of the housing and a plurality of outlet holes in a top wall of the housing, wherein the top wall is adapted to open the housing, a connecting device formed at the top wall of the housing, the connecting device provided for connecting the housing to the oven, wherein the connecting device is configured to connect the housing to the air outlet conduit, fixing elements adapted to fix the housing to an outside wall of the oven cavity, wherein all the fixing elements are configured to be arranged outside of the air outlet conduit, and at least one heating element provided for heating the catalytic filter system, wherein the heating element is arranged within the oven cavity and is additionally provided for heating the oven cavity, further wherein the catalytic filter system is arranged within the air outlet conduit and outside of the oven cavity such that the catalytic filter system is arranged at the outside of a cavity wall of the oven cavity.

17. The catalytic filter system according to claim 16, wherein the plurality of inlet holes is not the same size as the plurality of outlet holes.

18. The catalytic filter system according to claim 16, wherein the connecting device is formed as a one-piece part of the top wall of the housing.

19. The catalytic filter system according to claim 16, wherein a cross-section of the heating element is adapted to match a cross-section of the bottom wall of the housing.

* * * * *